US008788207B2

(12) United States Patent
Pei et al.

(10) Patent No.: US 8,788,207 B2
(45) Date of Patent: Jul. 22, 2014

(54) PRECISE BOREHOLE GEOMETRY AND BHA LATERAL MOTION BASED ON REAL TIME CALIPER MEASUREMENTS

(75) Inventors: Jianyong Pei, Katy, TX (US); Thomas Dahl, Schwuelper (DE); John Macpherson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 375 days.

(21) Appl. No.: 13/194,179

(22) Filed: Jul. 29, 2011

(65) Prior Publication Data

US 2013/0030705 A1 Jan. 31, 2013

(51) Int. Cl.
*E21B 47/08* (2012.01)

(52) U.S. Cl.
USPC ..... 702/6

(58) Field of Classification Search
USPC ..... 702/6–11; 340/853.1; 367/25, 35, 86
See application file for complete search history.

(56) References Cited

U.S. PATENT DOCUMENTS

| | | | | |
|---|---|---|---|---|
| 5,588,032 | A | 12/1996 | Johnson et al. | |
| 5,638,337 | A | 6/1997 | Priest | |
| 5,899,958 | A | 5/1999 | Dowell et al. | |
| 5,987,385 | A | 11/1999 | Varsamis et al. | |
| 6,038,513 | A | 3/2000 | Varsamis et al. | |
| 6,065,219 | A | 5/2000 | Murphey et al. | |
| 6,725,162 | B2 | 4/2004 | Edwards et al. | |
| 7,743,654 | B2 | 6/2010 | Spross et al. | |
| 2003/0114987 | A1 * | 6/2003 | Edwards et al. | 702/7 |
| 2005/0259512 | A1 | 11/2005 | Mandal | |
| 2005/0283315 | A1 | 12/2005 | Haugland | |
| 2008/0307875 | A1 | 12/2008 | Hassan et al. | |
| 2009/0114472 | A1 | 5/2009 | Winkler et al. | |
| 2009/0222209 | A1 | 9/2009 | Morys | |
| 2010/0076688 | A1 * | 3/2010 | Moake | 702/8 |
| 2010/0319991 | A1 | 12/2010 | Brannigan et al. | |

OTHER PUBLICATIONS

Priest, Computing Borehole Geometry and Related Parameters From Acoustic Caliper Data, Conference Paper, SPWLA 38th Annual Logging Symposium, Jun. 15-18, 1997, 13 pages, Society of Petrophysicists & Well Log Analysts.

DePavia et al. "Next-Generation Crosswell EM Imaging Tool," SPE 116344, SPE Annual Technical Conference and Exhibition, Sep. 21-24, 2008, pp. 1-11.

Smirnov et al. "Determination of Horizontal Borehole Geometry by Ultrasonic Pulse-Echo Method," SPE 117430, SPE Russian Oil and Gas Technical Conference and Exhibition, Oct. 28-30, 2008, pp. 1-9.

(Continued)

*Primary Examiner* — Manuel L Barbee
(74) *Attorney, Agent, or Firm* — Cantor Colburn LLP

(57) ABSTRACT

Disclosed is a method for estimating a geometry of a borehole penetrating the earth. The method includes: performing a plurality of borehole caliper measurements with N transducers at a plurality of times, wherein for each time a measurement set comprises measurements made by the N transducers at that time; dividing a cross-section of the borehole into S sectors; obtaining an estimate of the borehole geometry by connecting representative radius points in adjacent sectors; displacing each measurement set according to a displacement vector related to an offset of each measurement set from the estimated geometry if the displacement vector exceeds a selection criterion; iterating the obtaining an estimate of the borehole geometry and the displacing each measurement set based on a latest displacement vector; and providing a latest obtained estimate as the geometry of the borehole when all of the displacement vectors no longer exceed the selection criterion for the displacing.

20 Claims, 8 Drawing Sheets

(56) References Cited

OTHER PUBLICATIONS

Allouche et al. "High-resolution Images and Formation Evaluation in Slim Holes from a New Logging-While-Drilling Azimuthal Laterolog Device," SPE 131513. SPE EUROPE/EAGE, Jun. 14-17, 2010, pp. 1-10.

Verdur et al. "Sedimentological Analysis Utilizing the Circumferential Borehole Acoustic Image," SPWLA 32nd Annual Logging Symposium transactions: Society of Professional Well Log Analysts Jun. 16-19, 1991. pp. 1-19.

Notification of Transmittal of the International Search Report and the Written Opinion of the International Searching Authority, or the Declaration; PCT/US2012/048330; Jan. 29, 2013.

* cited by examiner

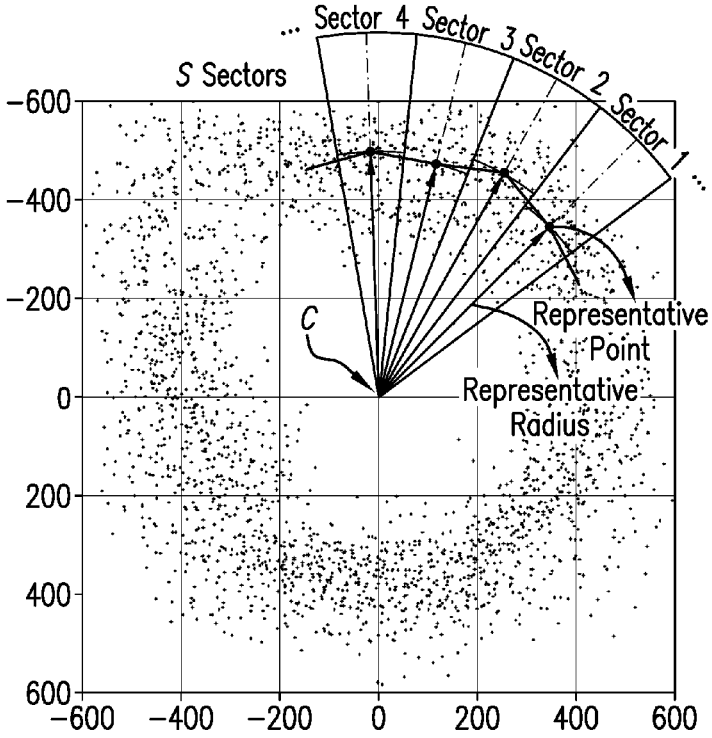
FIG.5
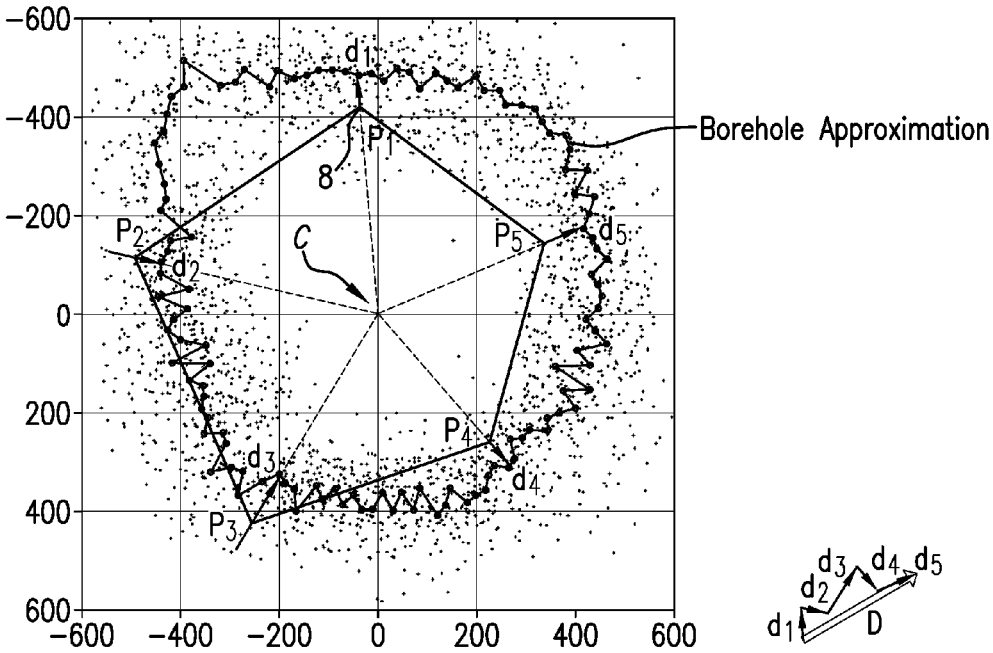
FIG.6a
FIG.6b

PRECISE BOREHOLE GEOMETRY AND BHA LATERAL MOTION BASED ON REAL TIME CALIPER MEASUREMENTS

BACKGROUND

Boreholes are drilled deep into the earth for many applications such as carbon sequestration, geothermal production, and hydrocarbon exploration and production. Many different types of sensors may be used to perform measurements while a borehole is being drilled in an operation referred to as logging-while-drilling (LWD).

The standoff of an LWD sensor while one or more measurements are taken is a very important parameter. One of the important applications, for example, is to perform environmental corrections of the LWD sensor measurements, which are sensitive to the distance or standoff from the sensor to the formation. Usually, multiple ultrasonic transducers are mounted around the circumference of a bottom hole assembly (BHA) housing the LWD sensors. Each transducer measures the distance (i.e., standoff) from itself to the borehole wall in the direction of the acoustic waves.

The standoff values can also be used to give the geometry of the borehole. If the borehole is an ideal circle and the center of the downhole drilling assembly is at the center of the borehole, for example, the borehole radius can be calculated by adding the radius of the tool (from the center to the sensor) and the standoff (from the sensor to the borehole wall). In real drilling situations, however, the center of the downhole drilling unit usually moves laterally in the cross-section of the borehole due to drilling vibrations. The trajectory of its lateral movement cannot be known a priori. As a result, the geometry of the borehole cannot be obtained directly from the standoff measurements and the tool diameter. An algorithm is therefore necessary to remove the effect introduced by the lateral movement of the center of the drilling unit. Typically, traditional methods for this purpose do not handle arbitrary borehole geometry. For example, some existing algorithms assume the shape of arbitrary borehole geometry is elliptical even when it is not. It would be well received in the drilling industry if estimates of arbitrary borehole geometry could be improved.

BRIEF SUMMARY

Disclosed is a method for estimating a geometry of a borehole penetrating the earth. The method includes: performing a plurality of borehole caliper measurements with N transducers at a plurality of times, wherein for each time a measurement set comprises measurements made by the N transducers at that time; dividing a cross-section of the borehole into S sectors, the cross-section being in an X-Y plane that is perpendicular or sub-perpendicular to a Z-axis that is a longitudinal axis of the borehole; obtaining an estimate of the borehole geometry by connecting in adjacent sectors a representative radius point that represents a radius representative of measurements in each sector; displacing each measurement set according to a displacement vector related to an offset of each measurement set from the estimated geometry if the displacement vector exceeds a selection criterion; iterating the obtaining an estimate of the borehole geometry and the displacing each measurement set based on a latest displacement vector; and providing a latest obtained estimate as the geometry of the borehole when all of the displacement vectors no longer exceed the selection criterion for the displacing.

Also disclosed is an apparatus for estimating a geometry of a borehole penetrating the earth. The apparatus includes: a carrier configured to be conveyed through the borehole; a plurality of sensors disposed at the carrier and configured to perform borehole caliper measurements at a plurality of times, wherein for each time in the plurality of times a measurement set comprises measurements made by the N transducers at that time; and a processor. The processor is configured to implement a method that includes: receiving a measurement set for each time in the plurality of times; dividing a cross-section of the borehole into S sectors, the cross-section being in an X-Y plane that is perpendicular or sub-perpendicular to a Z-axis that is a longitudinal axis of the borehole; obtaining an estimate of the borehole geometry by connecting in adjacent sectors a representative radius point that represents a radius representative of measurements in each sector; displacing each measurement set according to a displacement vector related to an offset of each measurement set from the estimated geometry if the displacement vector exceeds a selection criterion; iterating the obtaining an estimate of the borehole geometry and the displacing each measurement set based on a latest displacement vector; providing a latest obtained estimate as the geometry of the borehole when all of the displacement vectors no longer exceed the selection criterion for the displacing.

Further disclosed is a non-transitory computer readable medium having computer executable instructions for estimating a geometry of a borehole penetrating the earth by implementing a method. The method includes: receiving a plurality of borehole caliper measurements performed with a plurality of sensors at a plurality of times, wherein for each time in the plurality of times a measurement set comprises measurements made by the plurality of sensors at that time; dividing a cross-section of the borehole into S sectors, the cross-section being in an X-Y plane that is perpendicular or sub-perpendicular to a Z-axis that is a longitudinal axis of the borehole; obtaining an estimate of the borehole geometry by connecting in adjacent sectors a representative radius point that represents a radius representative of measurements in each sector; displacing each measurement set according to a displacement vector related to an offset of each measurement set from the estimated geometry if the displacement vector exceeds a selection criterion; iterating the obtaining an estimate of the borehole geometry and the displacing each measurement set based on a latest displacement vector; and providing a latest obtained estimate as the geometry of the borehole when all of the displacement vectors no longer exceed the selection criterion for the displacing.

BRIEF DESCRIPTION OF THE DRAWINGS

The following descriptions should not be considered limiting in any way. With reference to the accompanying drawings, like elements are numbered alike:

FIG. 5 depicts aspects of a borehole geometry;

FIGS. 6A and 6B depict aspects of calculating offset vectors;

DETAILED DESCRIPTION

A detailed description of one or more embodiments of the disclosed apparatus and method presented herein by way of exemplification and not limitation with reference to the Figures.

Disclosed are method and apparatus for accurately estimating arbitrary geometry of an earth borehole using borehole standoff measurements. In addition, lateral motion of a tool making the borehole standoff measurements is also estimated.

Figure 1:
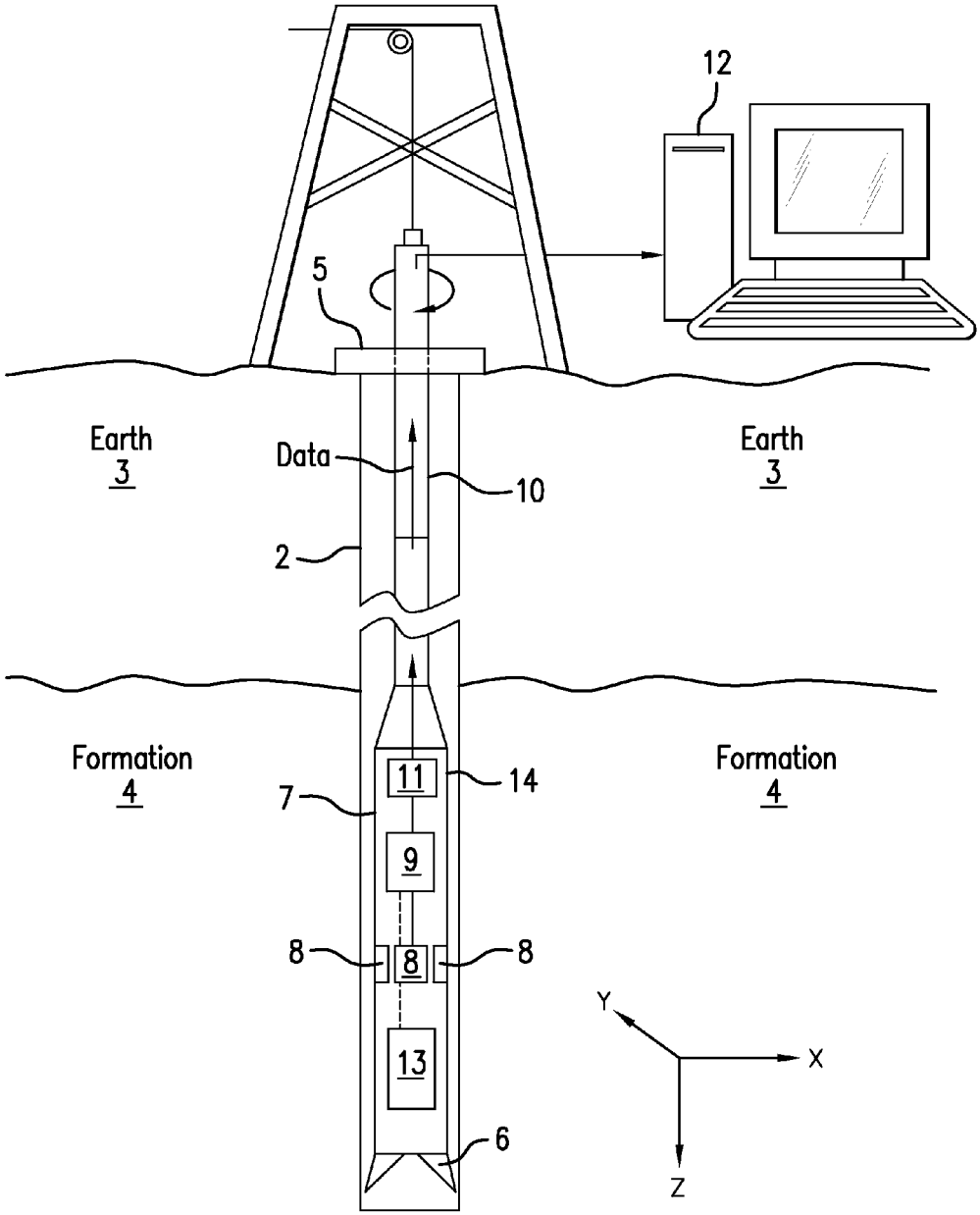
FIG. 1 illustrates an exemplary embodiment of a bottom hole assembly (BHA) disposed in a borehole penetrating the earth.

FIG. 1 illustrates an exemplary embodiment of a drill string 10 disposed in a borehole 2 penetrating the earth 3, which includes a geologic formation 4. While the borehole 2 is depicted as being vertical, the teachings are also applicable to deviated boreholes. A drill string rotation system 5 disposed at the surface of the earth 3 is configured to rotate the drill string 10 in order to rotate a drill bit 6 disposed at the distal end of the drill string 10. The drill bit 6 represents any cutting device configured to cut through the earth 3 or rock in the formation 4 in order to drill the borehole 2. Disposed adjacent to the drill bit 6 is a bottom hole assembly (BHA) 7. The BHA 7 can include downhole components such as a logging tool 13 configured to perform one or more various downhole measurements as the drill bit 6 drills the borehole 2 or during a temporary halt in drilling. The term "downhole" as a descriptor relates to being disposed in the borehole 2 as opposed to being disposed outside of the borehole 2 such as at or above the surface of the earth 3.

Still referring to FIG. 1, the BHA 7 includes N borehole caliper sensors 8, which can also be referred to as transducers. The term "caliper" relates to a diameter of the borehole 2. Each caliper sensor 8 is configured to measure a distance (generally referred to as standoff) from that sensor 8 to a wall of the borehole 2 directly in front of that sensor 8. Because the sensors 8 are generally disposed along the circumference of the BHA 7, the measured distance is adjusted to account for the offset of the sensors from the center C of the BHA 7. Thus, in one or more embodiments, each sensor 8 provides output measurements that are used to determine the distance from the center C of the BHA 7 to the borehole wall directly in front of the sensor 8 performing the measurement. The N sensors 8 can be evenly or unevenly distributed along the perimeter or circumference of the BHA 7. In both cases, the orientations (i.e., azimuthal directions) of the sensors' measurements are also recorded. In one or more embodiments, the orientation is obtained using one or more magnetometers that sense the direction of the Earth's magnetic field with respect to the tool face at the time of measurement. It can be appreciated, that in an alternative embodiment, the N caliper sensors 8 can be disposed in a downhole sensor sub 14 at any location along the drill string 10.

In one or more embodiments, the sensors 8 are ultrasonic acoustic transducers that are configured to emit an acoustic wave and receive a reflection of the wave. By measuring a transit time such as with the downhole electronics 9, the distance from the acoustic transducer to the wall of the borehole 2 in front the transducer can be measured. It can be appreciated that the sensors 8 can also be configured to operate on other principles such as optical, electrical, magnetic or radiation as non-limiting examples. In general, borehole caliper measurements by the N sensors 8 are performed at substantially the same time.

Still referring to FIG. 1, the downhole electronics 9 are coupled to the sensors 8, are used to operate the sensors 8, and receive and process measurements from the sensors 8. In addition, in one or more embodiments, the downhole electronics 9 can transmit the measurements to a computer processing system 12 disposed at the surface of the earth 3 for processing. A telemetry system 11 can be used to communicate data between the downhole electronics 9 and the computer processing system 12. The data can include the borehole geometry determined by an algorithm performed in the downhole electronics 9 using the sensor measurements or the data can include the sensor measurements so that the algorithm can be performed by the surface computer processing system 12 to determine the borehole geometry. In one or more embodiments, the telemetry system 11 uses wired drill pipe for real time communications. Other non-limiting embodiments of the telemetry system 11 use mud-pulses, electromagnetic energy, or acoustic energy for signal transmission.

Figure 2:
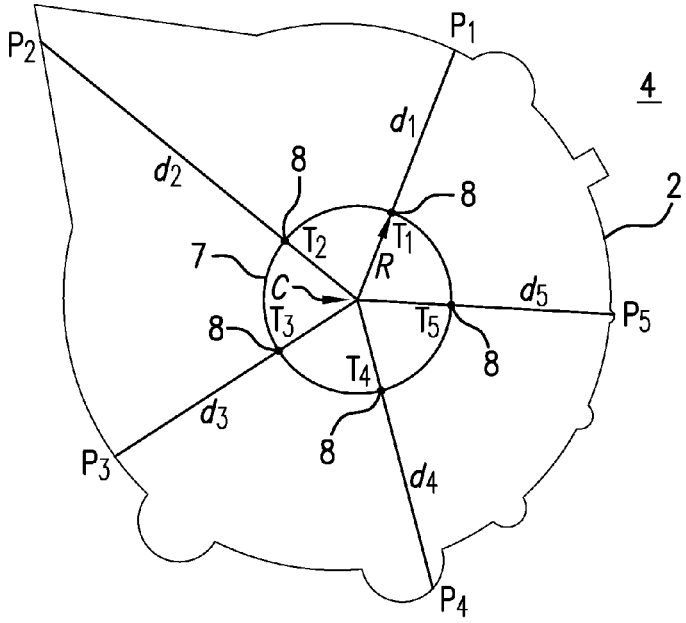
FIG. 2 illustrates a configuration of acoustic sensors in the BHA.

Reference may now be had to FIG. 2, which depicts aspects of measuring borehole caliper. In the embodiment of FIG. 2, there are five (N=5) evenly distributed (e.g. 72° apart) acoustic transducers 8 labeled $T_1$-$T_5$. The ultrasonic transducers 8 obtain data to calculate their distances (i.e., standoff) to the borehole wall by measuring the two-way transit time of the emitted acoustic wave. Assuming the acoustic wave from transducer $T_i$ hits the borehole wall at point $P_i$, and the measured travel time is $t_i$, the distance from $T_i$ to $P_i$ is: $d_i=V_m(t_i/2)$ where $V_m$ is the acoustic velocity in the drilling mud at downhole conditions (i.e., temperature, pressure, components for example). The distance from the center of the BHA 7 to the borehole wall in the direction of the transducer $T_i$ is therefore $(d_i+R)$, where R is the radius of the BHA 7.

Figure 3:
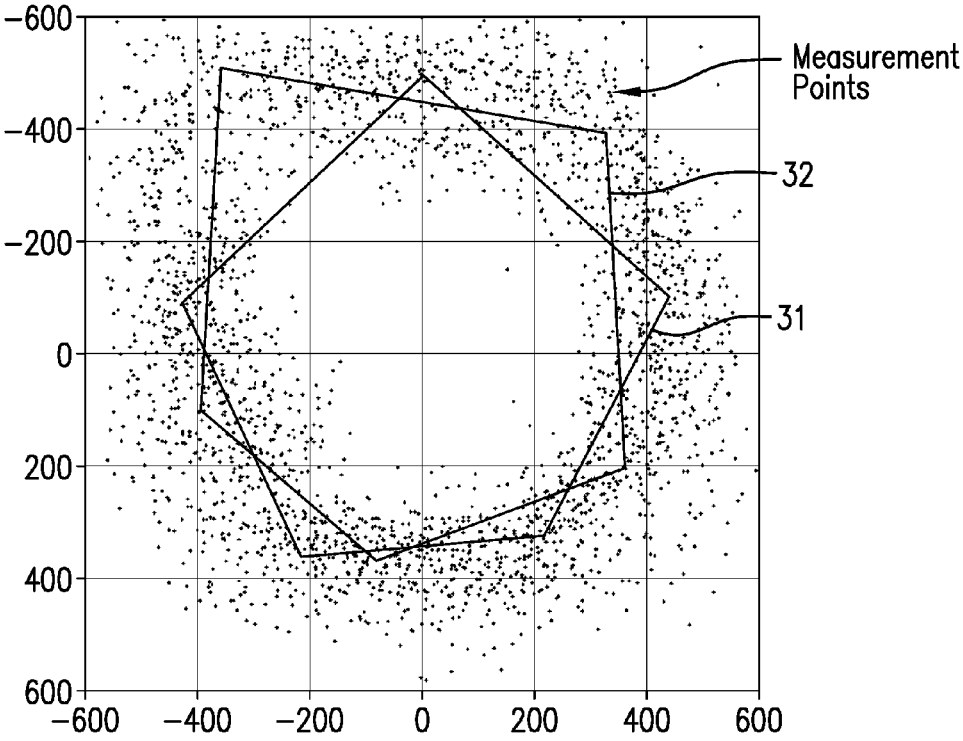
FIG. 3 depicts aspects of two pentagons derived from measurements as two different times.

At each measurement time, all transducers are triggered at substantially the same time. For the configuration shown in FIG. 2, the distances from five points on the borehole wall ($P_1$~$P_5$) to the center C of the BHA 7 are obtained. In other words, the location of a pentagon $P_1P_2P_3P_4P_5$ (i.e. five sided polygon) relative to the center C of the BHA 7 is obtained. The N caliper measurements performed at substantially the same time by the N sensors 8 are referred to herein as a measurement set. The measurement sets are taken at high frequency relative to the longitudinal movement of the BHA 7. Hence, over time, many points around the same borehole cross-section are measured as shown in FIG. 3. FIG. 3 also illustrates two measurement sets shown as two pentagons (31 and 32).

Figure 4:
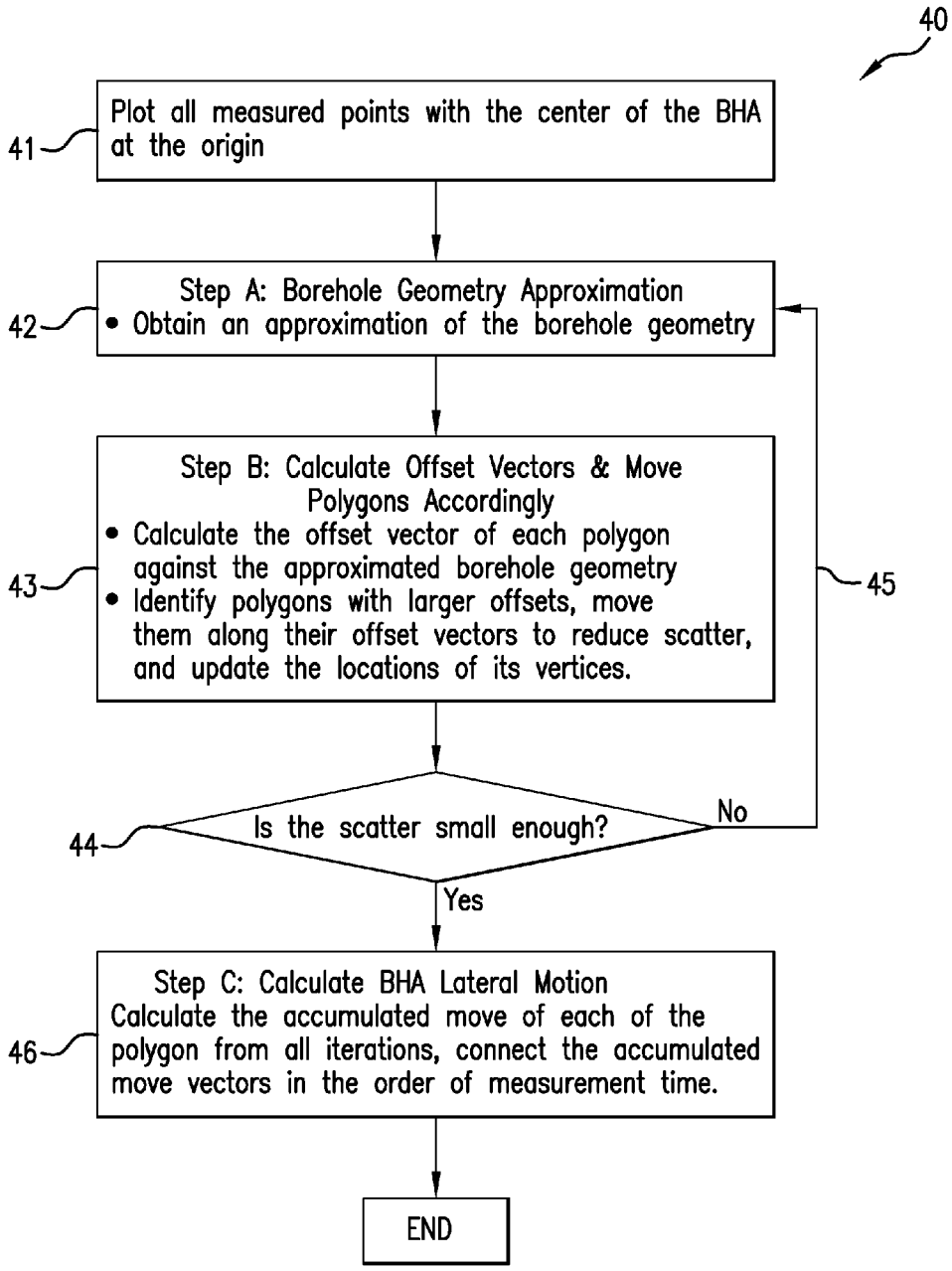
FIG. 4 is a flowchart of a method for estimating a geometry of the borehole from acoustic caliper measurements.
Figure 7A:
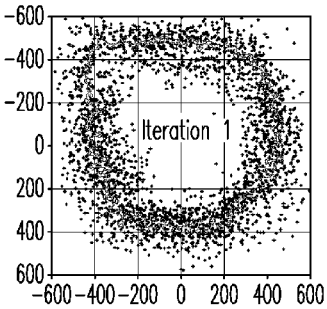
FIGS. 7*a*-7*i* depict aspects of application of the method with five evenly distributed acoustic transducers and 120 sectors.
Figure 7B:
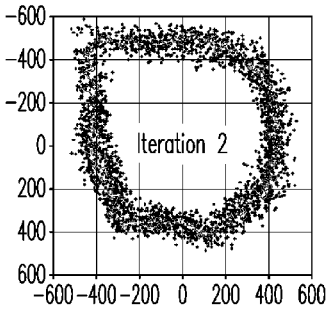
Figure 7C:
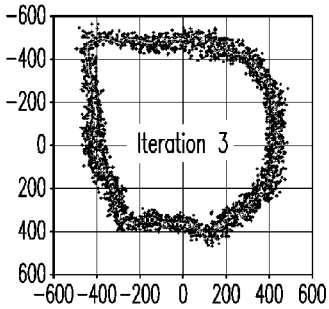
Figure 7D:
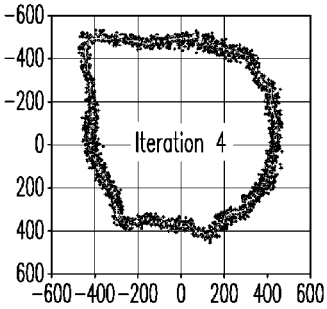
Figure 7E:
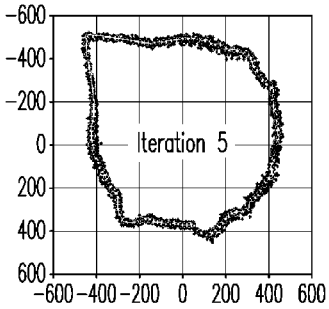
Figure 7F:
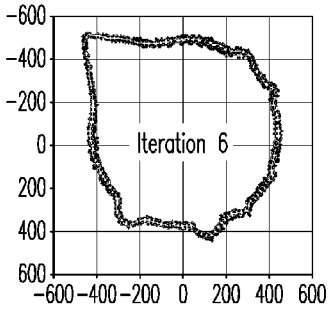
Figure 7G:
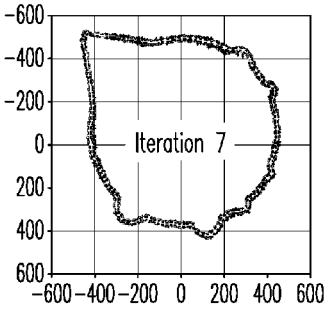
Figure 7H:
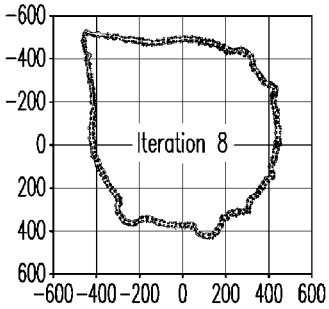
Figure 7I:
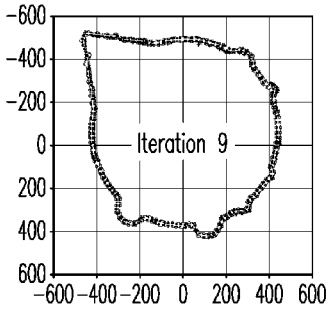

The algorithm (40) used to estimate a geometry of the borehole 2 using caliper measurements from the N sensors 8 is now discussed in detail with reference to FIG. 4. Step 41 calls for positioning (e.g. plotting) all measured points with the origin of the coordinate system at the center C of the BHA 7 using the sensor measurements and their orientations. All of the measured points are obtained from all of the measurement sets where each measurement set includes N measurements made by N sensors 8 at substantially the same time.

Step 42 calls for obtaining a first estimate or approximation of the borehole geometry. The first approximation is obtained by dividing the measured cross-section (X-Y plane that is perpendicular or sub-perpendicular to longitudinal axis of the borehole) of the borehole into S sectors as illustrated in FIG. 5. The larger S is, the higher the resolution of the borehole geometry will be. There are a certain number of points falling into each sector. The radius of each measured point is its distance from the origin. Within each sector, a histogram of radii can be created, which includes a number of points having a radius that falls into a range of radii. A representative radius is then calculated for this sector, based on the radius histogram. The representative radius is defined as a radius in the range of radii having the highest density or number of points. Various algorithms can be used to obtain the representative radius. A representative radius point based on the representative radius is plotted generally in the center of the sector, but it does not have to be. Adjacent representative radius points are then connected to obtain a closed curve. This closed curve is the first approximation of the true borehole geometry.

Step 43 calls for calculating offset vectors for each measurement set and displacing the measurement set if the sum of offset vectors exceeds a selected criteria. For each N-sided polygon (representing a measurement set), whose vertices are N measured points (illustrated by $P_1$~$P_5$ in FIG. 6A), straight lines are drawn from the origin to all of its vertices. These straight lines intersect with the approximated borehole geometry obtained from Step 42. For each vertex, an offset vector is defined as the vector from the vertex to the intersection (illustrated by $d_1$~$d_5$ in FIG. 6). For each polygon, a vector sum D of the offset vectors is obtained where $$D = \sum_{i=1}^{N} d_i$$

as illustrated in FIG. 6B. The vector sum D is defined as the total offset vector for its associated polygon. The total offset distance D for the associated polygon is then defined as the length of the vector D.

Once the total offset vectors and the total offset distances are calculated for all polygons, it is decided which of the polygons will be corrected to reduce scatter of the measurement points (Step 44). Various criteria can be used to select the polygons or measurement sets to be corrected. In one or more embodiments, only those polygons whose offset distances are larger than the mean offset distance of all the polygons are corrected.

For all polygons that will be corrected, the polygons (i.e., all of its vertices) are moved or displaced in the direction of the vector sum D for a distance of D/(N−1). In other words, the actual move of the polygon is mathematically described as $\delta = D/(N-1)$ where $\delta$ is the displacement vector of the polygon or measurement set. The vertices of the corrected polygons are updated based on the displacement vector and a second approximation or estimate of the borehole geometry is created as in step 42, but using the vertices (i.e., measurement points) of the corrected polygons and the vertices of any un-corrected polygons. In this manner, steps 42 and 43 can be iterated (Step 45) using a latest obtained displacement vector until all the total offset distances or the displacement vectors satisfy a selection criterion for moving the polygons. If the scatter is small enough in step 44, then the latest obtained estimate of the borehole geometry is output as the borehole geometry.

In step 46, the lateral motion of the BHA 7 and the trajectory of the center C of the BHA 7 are calculated. For each polygon, the accumulated move vector is obtained by summing up its actual move vectors from all the iterations ($N_{iteration}$=total number of iterations) where $$\sum \delta = \sum_{i=1}^{N_{iteration}} \delta_i.$$

If the start of $\Sigma\delta$ is at the origin, then the end of the summation shows the location of the center of the BHA 7 at the time of measurement represented by this polygon. The trajectory of the center of the BHA 7 is obtained by connecting the ends of the accumulated move vectors, in the order of the measurement times with the starting points of the vectors being at the origin.

An example of an application of the algorithm is now provided using the measurements shown in FIG. 3. The number of sectors used in this example is S=120. The updated location of the measured points and the approximated borehole geometry after each iteration are shown in FIG. 7. After the ninth iteration, the very irregular borehole geometry is very well captured.

Figure 8:
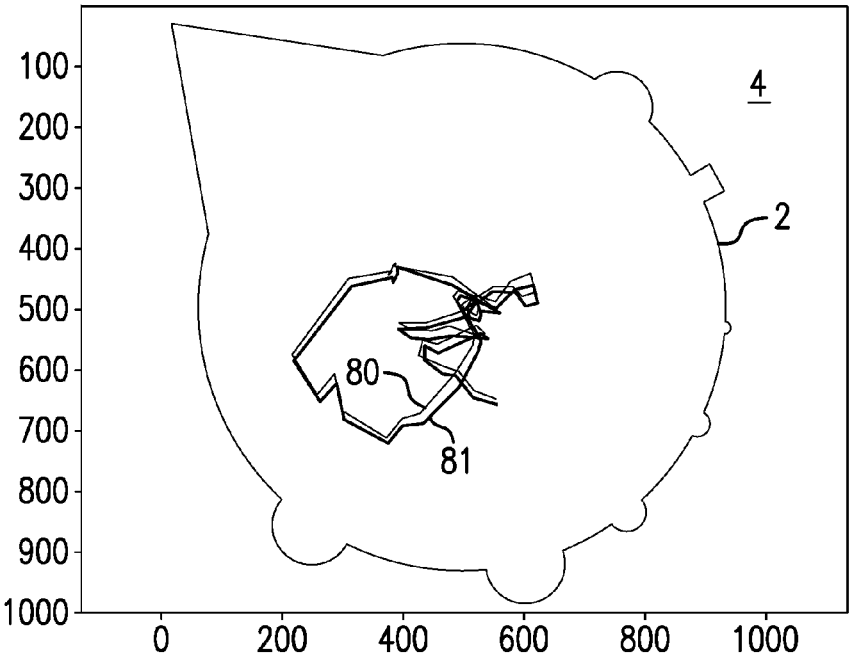
FIG. 8 depicts aspects of lateral motion of the BHA.

FIG. 8 depicts aspects of the derived lateral motion (80) from the example in FIG. 7. FIG. 8 also illustrates the real motion (81) of the BHA 7 from which the measurements were made. Only fifty time steps (i.e., fifty measurement sets) are shown so that the figures are not overly crowded. The derived motion is very close to the real motion.

Figure 9:
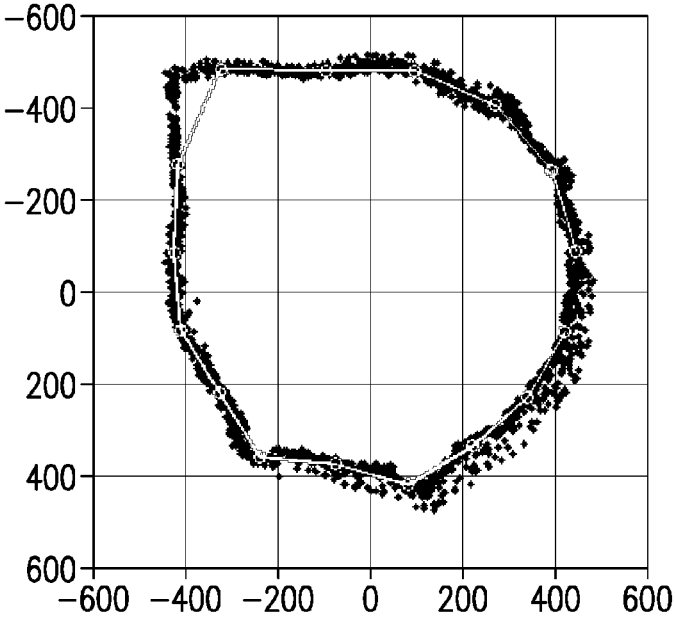
FIG. 9 depicts aspects of application of the method with five evenly distributed acoustic transducers and 16 sectors.

FIG. 9 illustrates an application of the algorithm applied to the same measurements shown in FIG. 3 with five evenly distributed transducers, but with the number of sectors S=16. At the end of nine iterations as shown in FIG. 9, the borehole geometry is recovered but with a coarser geometry than when S=120.

Figure 10A:
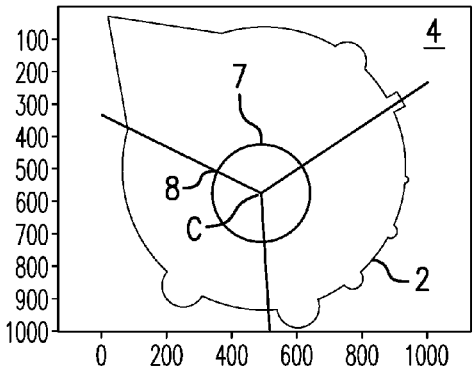
FIGS. 10A and 10B depict aspects of application of the method with three evenly distributed acoustic transducers and 120 sectors.
Figure 10B:
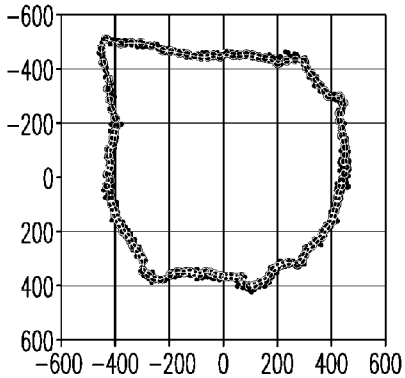
Figure 11A:
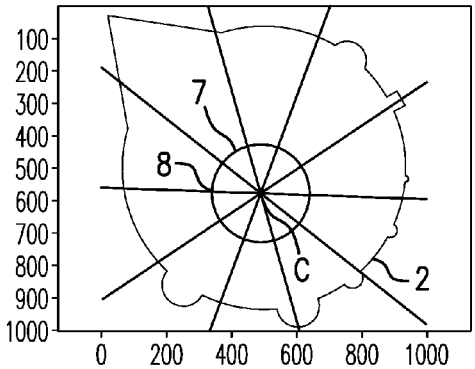
FIGS. 11A and 11B depict aspects of application of the method with ten evenly distributed acoustic transducers and 120 sectors.
Figure 11B:
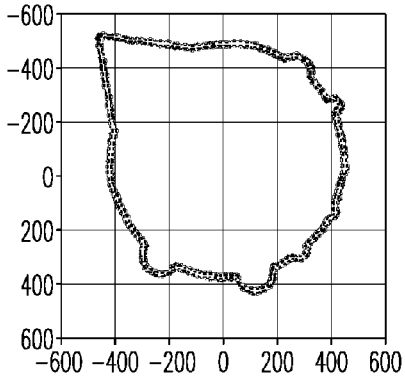

The algorithm can handle any number of transducers 8 in the BHA 7. FIG. 10 shows its application to three evenly distributed transducers, while FIG. 11 shows its application to ten evenly distributed transducers. FIGS. 10A and 11A show the borehole geometry and the transducer set-up, while FIGS. 10B and 11B show the derived borehole geometry. In general, the more transducers there are, the more measured points, and the better the derived borehole geometry.

Figure 12A:
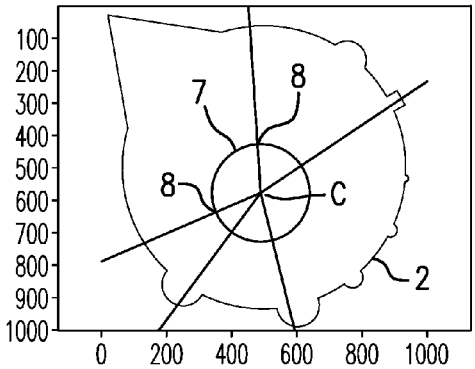
FIGS. 12A and 12B depict aspects of application of the method with five unevenly distributed acoustic transducers and 120 sectors.
Figure 12B:
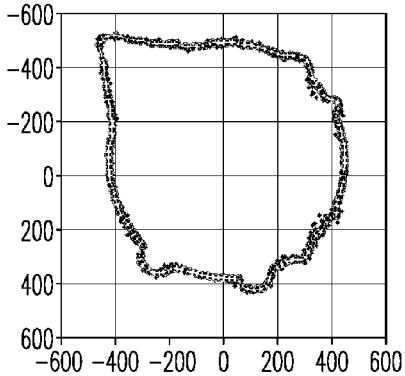

The algorithm is very flexible so that it can be applied to non-regular transducer arrangements. FIG. 12 illustrates an example where five transducers 8 are unevenly distributed about the circumference of the BHA 7.

Figure 13:
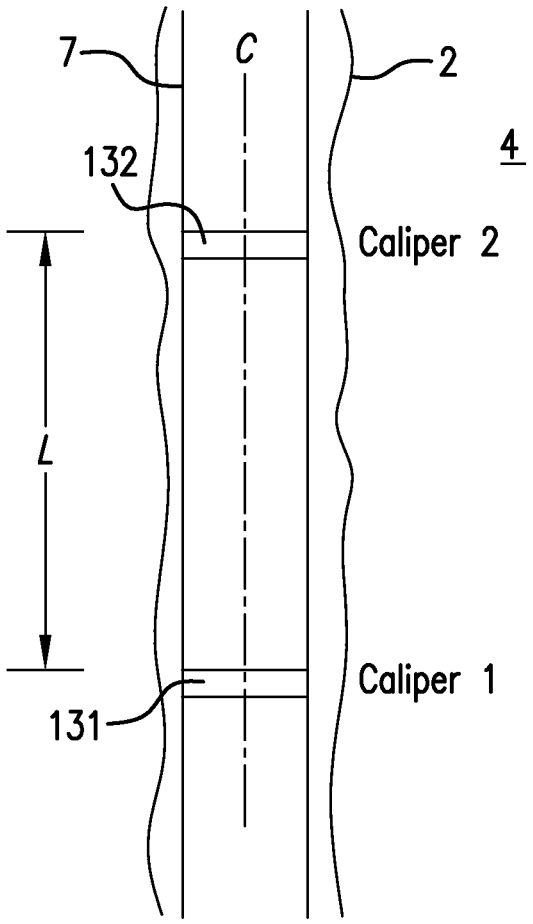
FIG. 13 depicts aspects of measuring two calipers at different depths to measure rate of penetration.

Because of the high resolution of the algorithm, it can be used to measure the rate of penetration (ROP) of the drill bit 6. To measure ROP, the BHA 7 requires at least two sets of transducers 8. As illustrated in FIG. 13, a first set of transducers 131 is spaced a distance L from a second set of transducers 132. With the first set of transducers 131 closest to the drill bit 6, a time T is measured that it takes for the second set of transducers 132 to measure the same borehole geometry as the first set of transducers 131. The ROP is then calculated as ROP=L/T. The more frequent the variations of borehole geometry with depth, the more accurate the ROP calculation will be.

The disclosed apparatus and method have several advantages. One advantage over prior art algorithms is that the present algorithm can estimate precise borehole geometry and does not assume that the shape of the borehole is elliptical. Another advantage is that due to the flexibility of the algorithm, it can still be applied in cases where one or more transducers fail, but still have a plurality of working transducers. Another advantage is that the algorithm is suited to downhole applications. Due to limited space in the BHA, the processing power of processors may be limited, but the algorithm can still be executed by those processors. The algorithm is simple and does not involve advanced mathematical methods or large scale computations. Still another advantage is that the resolution of the estimated borehole geometry can be specified by selecting an appropriate criterion for moving or displacing the polygons. Hence, lower resolution estimates, which may be suitable in certain applications, can be performed in a shorter time than higher resolution estimates. Yet another advantage is the algorithm applies to any type of sensor that can measure borehole caliper or standoff.

In support of the teachings herein, various analysis components may be used, including a digital and/or an analog system. For example, the sensors 8, the downhole electronics 9 or the surface computer processing 12 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order. The term "couple" relates to coupling a first component to a second component either directly or indirectly through an intermediate component.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for estimating a geometry of a borehole penetrating the earth, the method comprising:

performing a plurality of borehole caliper measurements with N transducers at a plurality of times, wherein for each time a measurement set comprises measurements made by the N transducers at that time;

dividing a cross-section of the borehole into S sectors, the cross-section being in an X-Y plane that is perpendicular or sub-perpendicular to a Z-axis that is a longitudinal axis of the borehole using a processor;

obtaining an estimate of the borehole geometry by connecting in adjacent sectors a representative radius point that represents a radius representative of measurements in each sector using a processor;

displacing each measurement set according to a displacement vector related to an offset of each measurement set from the estimated geometry if the displacement vector exceeds a selection criterion using a processor;

iterating the obtaining an estimate of the borehole geometry and the displacing each measurement set based on a latest displacement vector using a processor; and providing a latest obtained estimate as the geometry of the borehole when all of the displacement vectors no longer exceed the selection criterion for the displacing using a processor.

2. The method according to claim 1, wherein the N transducers are disposed on a perimeter of a bottom hole assembly or downhole sensor sub configured to be conveyed through the borehole, a center C of the perimeter being a reference point from which the borehole caliper measurements are referenced.

3. The method according to claim 2, wherein the bottom hole assembly has a circular cross-section in the X-Y plane and the perimeter is a circumference of the bottom hole assembly.

4. The method according to claim 3, wherein a radius r for each measurement is calculated by adding a distance from the center C and a standoff measured by one of the N transducers performing the measurement.

5. The method according to claim 4, wherein the obtaining a first estimate of the borehole geometry comprises creating a histogram for each sector, the histogram comprising a number or measurement points versus a range of radii that the measurement points fall into.

6. The method according to claim 5, wherein the first representative radius for each sector comprises a radius in a range of radii having a highest density of measurement points.

7. The method according to claim 2, wherein the displacing comprises:

creating an N-sided polygon for each measurement set wherein each vertex represents one measurement;

creating a straight line from the center C through each vertex wherein the line intersects the first estimate of the borehole geometry;

determining an offset vector $d_i$ for each vertex, the offset vector comprising a distance and direction along the straight line to the intersection of the first estimate of the borehole geometry;

summing the offset vectors $d_i$ for each polygon to obtain a vector sum D where $$D = \sum_{i=1}^{N} d_i.$$

8. The method according to claim 7, wherein the displacing further comprises moving each polygon that exceeds the selection criterion a distance δ where δ=D/(N−1) in the direction of D.

9. The method according to claim 8, further comprising estimating the center C of the BHA at the time the associated measurement set was performed by summing all move vectors $\delta_i$ for all iterations $N_{iteration}$ where $$\sum \delta = \sum_{i=1}^{N_{iteration}} \delta_i$$

and moving from the center point C according to δ.

10. The method according to claim 9, further comprising estimating the trajectory of the center C of the BHA by connecting ends of each successive move vector $\delta_i$ corresponding to a sequence of measurement times for the associated polygon.

11. The method according to claim 1, further comprising determining a mean displacement of the first displacement vectors and setting the selection criteria to the mean displacement.

12. The method according to claim 1, wherein the N transducers comprises a first set of sensors spaced a distance L from a second set of sensors along a longitudinal axis of the borehole and the method further comprises estimating a rate of penetration (ROP) of the first and second set of sensors into the borehole by dividing L by a time T it takes for the second set of sensors to measure a same borehole geometry as the first set of sensors where ROP=L/T.

13. The method according to claim 1, wherein a sensor in the plurality of sensors is not operable.

14. An apparatus for estimating a geometry of a borehole penetrating the earth, the apparatus comprising:

a carrier configured to be conveyed through the borehole;

a plurality of sensors disposed at the carrier and configured to perform borehole caliper measurements at a plurality of times, wherein for each time in the plurality of times a measurement set comprises measurements made by the plurality of sensors at that time; and a processor configured to implement a method comprising:

receiving a measurement set for each time in the plurality of times;

dividing a cross-section of the borehole into S sectors, the cross-section being in an X-Y plane that is perpendicular or sub-perpendicular to a Z-axis that is a longitudinal axis of the borehole;

obtaining an estimate of the borehole geometry by connecting in adjacent sectors a representative radius point that represents a radius representative of measurements in each sector;

displacing each measurement set according to a displacement vector related to an offset of each measurement set from the estimated geometry if the displacement vector exceeds a selection criterion;

iterating the obtaining an estimate of the borehole geometry and the displacing each measurement set based on a latest displacement vector; and providing a latest obtained estimate as the geometry of the borehole when all of the displacement vectors no longer exceed the selection criterion for the displacing.

15. The apparatus according to claim 14, wherein carrier comprises a bottom hole assembly (BHA).

16. The apparatus according to claim 15, wherein the plurality of sensors is evenly distributed about a circumference of the BHA.

17. The apparatus according to claim 15, wherein the plurality of sensors is unevenly distributed about a circumference of the BHA.

18. The apparatus according to claim 14, wherein the plurality of sensors comprises a first set of sensors spaced a distance L from a second set of sensors along a longitudinal axis of the borehole.

19. The apparatus according to claim 14, wherein the plurality of sensors comprise acoustic transducers.

20. A non-transitory computer readable medium comprising computer executable instructions for estimating a geometry of a borehole penetrating the earth by implementing a method comprising:

receiving a plurality of borehole caliper measurements performed with a plurality of sensors at a plurality of times, wherein for each time in the plurality of times a measurement set comprises measurements made by the plurality of sensors at that time;

dividing a cross-section of the borehole into S sectors, the cross-section being in an X-Y plane that is perpendicular or sub-perpendicular to a Z-axis that is a longitudinal axis of the borehole;

obtaining an estimate of the borehole geometry by connecting in adjacent sectors a representative radius point that represents a radius representative of measurements in each sector;

displacing each measurement set according to a displacement vector related to an offset of each measurement set from the estimated geometry if the displacement vector exceeds a selection criterion;

iterating the obtaining an estimate of the borehole geometry and the displacing each measurement set based on a latest displacement vector; and providing a latest obtained estimate as the geometry of the borehole when all of the displacement vectors no longer exceed the selection criterion for the displacing.

* * * * *